US010093862B2

(12) United States Patent
Kyllönen et al.

(10) Patent No.: US 10,093,862 B2
(45) Date of Patent: Oct. 9, 2018

(54) METHOD FOR SEPARATING HYDROCARBONS AND USE OF MOLTEN SALT

(71) Applicant: Kemira Oyj, Helsinki (FI)

(72) Inventors: Lasse Kyllönen, Espoo (FI); Alistair King, Helsinki (FI); Samantha Kiljunen, Lappeenranta (FI); Mehrdad Hesampour, Espoo (FI)

(73) Assignee: Kemira Oyj, Helsinki (FI)

( * ) Notice: Subject to any disclaimer, the term of this patent is extended or adjusted under 35 U.S.C. 154(b) by 0 days.

(21) Appl. No.: 15/318,743

(22) PCT Filed: Jun. 17, 2015

(86) PCT No.: PCT/FI2015/050441
§ 371 (c)(1),
(2) Date: Dec. 14, 2016

(87) PCT Pub. No.: WO2015/193550
PCT Pub. Date: Dec. 23, 2015

(65) Prior Publication Data

US 2017/0130135 A1 May 11, 2017

(30) Foreign Application Priority Data

Jun. 17, 2014 (FI) ..... 20145569

(51) Int. Cl.
*C10G 1/04* (2006.01)

(52) U.S. Cl.
CPC ..... *C10G 1/045* (2013.01); *C10G 2300/4081* (2013.01)

(58) Field of Classification Search
CPC ..... C10G 1/04; C10G 21/00; C10G 21/06; C10G 21/08; C10G 2300/4081
See application file for complete search history.

(56) References Cited

U.S. PATENT DOCUMENTS 2,594,044 A 4/1952 Loder
2,954,825 A 10/1960 Bernard et al.
(Continued)

FOREIGN PATENT DOCUMENTS

EP 2578285 A1 4/2013
WO 2011050469 A1 5/2011

OTHER PUBLICATIONS

Bier & Dietrich, Vapor Pressure of Ionic Liquids, Jun. 10, 2010.*
(Continued)

*Primary Examiner* — Prem C Singh
*Assistant Examiner* — Brandi M Doyle
(74) *Attorney, Agent, or Firm* — Berggren LLP

(57) ABSTRACT

The invention relates to a use of a reversible molten salt for separating hydrocarbons, such as crude bitumen and/or heavy crude oil, from material comprising mineral solids. The invention relates also to a method comprising at least the steps of: (a) bringing a liquid phase comprising a reversible molten salt, preferably a reversible ionic liquid, in a contact with mineral solids comprising hydrocarbons and extracting hydrocarbons to the liquid phase from the mineral solids; (b) separating the mineral solids phase from the liquid phase, which comprises molten salt and hydrocarbons; (c) separating hydrocarbons from the liquid phase comprising molten salt; and (d) recycling the liquid phase comprising molten salt to step (a).

17 Claims, 1 Drawing Sheet

(56) References Cited

U.S. PATENT DOCUMENTS

| | | | | |
|---|---|---|---|---|
| 3,129,165 | A * | 4/1964 | Visser | C10G 9/34 208/259 |
| 4,130,491 | A * | 12/1978 | Wagner | C09K 8/584 166/275 |
| 2011/0042318 | A1 | 2/2011 | Painter et al. | |
| 2011/0108466 | A1 | 5/2011 | Petcavich | |
| 2011/0257334 | A1* | 10/2011 | Jessop | C07C 257/14 525/50 |
| 2012/0048783 | A1* | 3/2012 | Painter | C10G 1/04 208/390 |
| 2013/0327989 | A1 | 12/2013 | Jessop et al. | |

OTHER PUBLICATIONS

Blasucci, V.M et al. Reversible ionic liquids designed for facile separation. Fluid Phase Equilibria 2010, 294, pp. 1-6, paragraph 21.1 and Fig. 6.

Angell, C.A. et al. Parallel developments in aprotic and protic ionic liquids: Physical Chemistry and Applications, Accounts of Chemical Research 2007, 40(11), pp. 1228-123, pp. 1233-1236.

Pollet, P. et al., Solvents for sustainable chemical processes. Green Chemistry, 2014, vol. 16, No. 3, pp. 1034-1055, Mar. 2014, pp. 1048-1051.

Paul Painter et al. "Recovery of Bitumen from Oil or Tar Sands Using Ionic Liquids" Energy & Fuels, vol. 24, No. 2, Feb. 18, 2010, pp. 1094-1098, XP055048181. ISSN: 0887-0624, DOI: 10.1021/ef9009586, p. 1095-1096; table 1, figure 1.

Phillip Williams et al. "Recovery of Bitumen from Low-Grade Oil Sands Using ionic Liquids", Energy & Fuels, vol. 24, No. 3, Mar. 18, 2010, pp. 2172-2173, XP055048183. ISSN: 0887-0624, DOI: 10.10211ef901384s, p. 2172.

Search Report, Finnish patent and registration office, dated Feb. 19, 2015.

Colombian Patent Office, Official Action of Colombian patent application NC2016/0004853, dated Mar. 2, 2018.

* cited by examiner

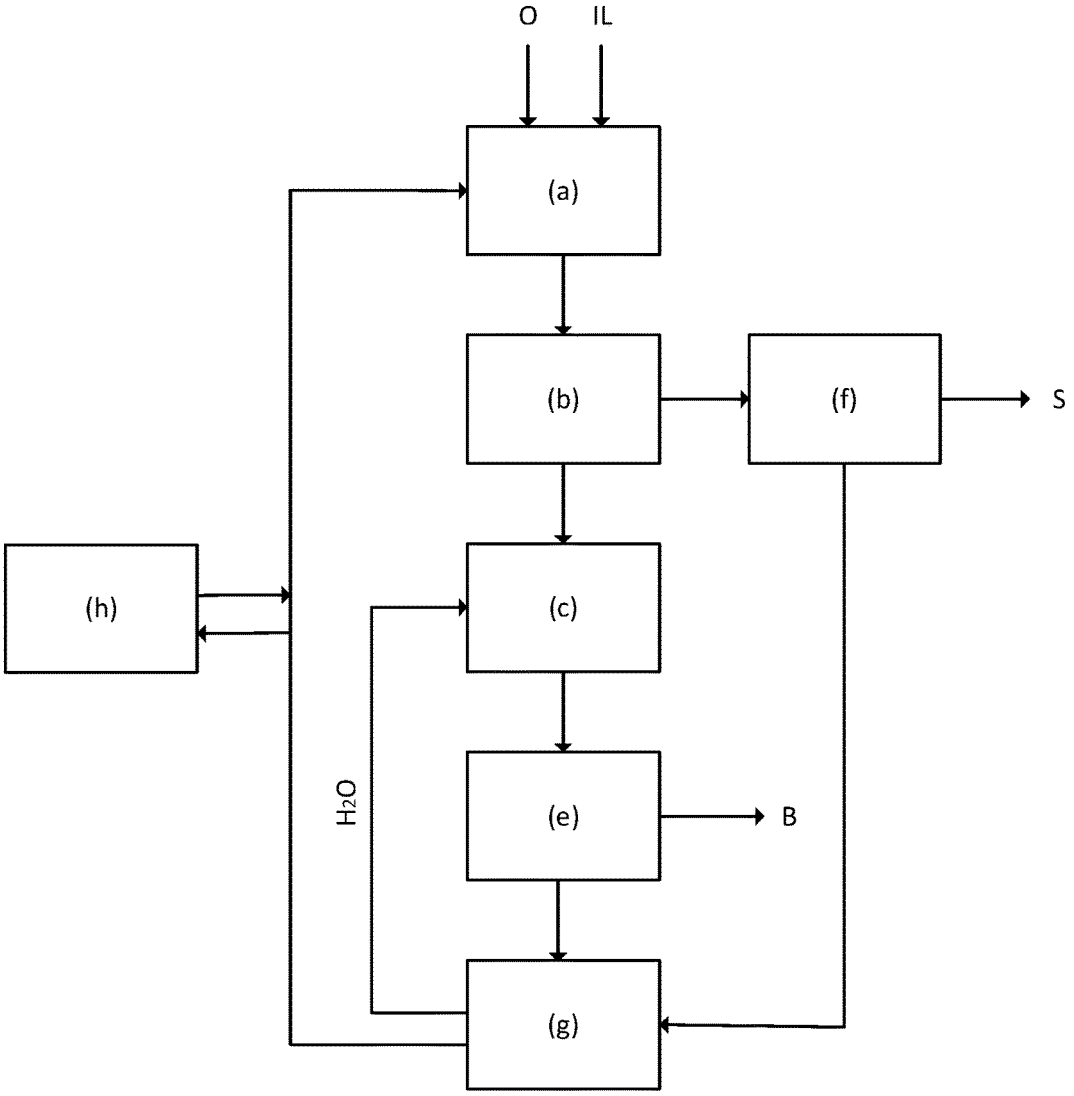
O
IL
(a)
(b)
(f)
S
(h)
(c)
$H_2O$
(e)
B
(g)

METHOD FOR SEPARATING HYDROCARBONS AND USE OF MOLTEN SALT

PRIORITY

This application is a U.S. national application of PCT-application PCT/Fl2015/050441filed on Jun. 17, 2015 and claiming priority of Finnish national application Fl 20145569filed on Jun. 17, 2014, the contents of all of which are incorporated herein by reference.

The present invention relates to a method for separating hydrocarbons and to a use of a molten salt according to preambles of enclosed independent claims.

Oil sands, which are also known as tar sands, are mixtures of clay, sand, water, and heavy hydrocarbons, such as bitumen. They provide a potential source of hydrocarbons for petrochemical industry. However, the known processes for separating and recovering hydrocarbons from oil sands are expensive, complicated and produce significant environmental damage. The conventional bitumen extraction methods use hot water and caustic soda to separate bitumen from sand and clay in a froth-flotation process. Tailings from the flotation process are treated through various recovery cycles. Problematically, tailings contain natural surfactants, which stabilize the tailings mixture of clay, sand and alkali, and prevent effective removal of hydrocarbon residues and excess water from the said tailings mixture. The result is an aqueous caustic mud-like mixture, which contains a high concentration of toxic hydrocarbons and trace elements, such as arsenic. This hazardous mixture cannot be piled, and it is difficult to transport, treat or store in a safe and environmentally sustainable manner. Similar problems may also be related to recovery of oil from oil shale. Consequently there exists a need for improved methods for separating hydrocarbons from material comprising mineral solids, such as sand and clay.

An object of this invention is to minimise or even totally eliminate the disadvantages existing in the prior art.

Another object of the present invention is to provide an inexpensive, simple method for separating hydrocarbons, such as bitumen, from material comprising mineral solids, for example from oil sands or the like.

A further object of the present invention is to provide a method which would be effective and environmentally feasible, and it should be easy to scale up into industrial scale.

The invention is defined in the characterising parts of the enclosed independent claims. Some preferable embodiments of the invention are defined in the dependent claims. All described features apply both for the use as well as the method of the invention, whenever applicable, even if it not necessarily stated so.

The present invention typically relates to a use of a reversible molten salt, preferably a reversible ionic liquid, for separating hydrocarbons, such as crude bitumen and/or heavy crude oil, from material comprising mineral solids.

Typical method for separating hydrocarbons, such as crude bitumen and/or heavy crude oil, from mineral solids, comprises at least the steps of (a) bringing a liquid phase comprising a reversible molten salt, preferably a reversible ionic liquid, in a contact with mineral solids comprising hydrocarbons and extracting hydrocarbons to the liquid phase from the mineral solids,
(b) separating the mineral solids phase from the liquid phase, which comprises molten salt and hydrocarbons,
(c) separating hydrocarbons from the liquid phase comprising molten salt, (d) recycling the liquid phase comprising molten salt to step (a).

Now it has been surprisingly found out that a reversible molten salt, preferably a reversible ionic liquid, can be successfully used for separation of hydrocarbons from material comprising mineral solids, such as sand and/or clay, as well as hydrocarbons. Hydrocarbons are effectively separated from the mineral solids into a liquid phase comprising the reversible molten salt. The separation efficiency is at least as good as with prior art methods, typically much better. The molten salt is reversible, which means that it can be easily recycled and reused in the separation process, which substantially improves the process economy. The mineral solids, which are obtained as the solid phase from the process, are clean, easy to handle and they can be deposited without harmful environmental effects. Overall the present invention provides a process with great environmental and economic benefits.

In the present context the term "molten salt" encompasses all molten salts that can be reused and recycled within the present method. The term encompasses eutectic mixtures and ionic liquids. According to one preferred embodiment of the invention, the molten salt is a reversible ionic liquid. The term "ionic liquid" is here understood to be an ionic salt-like material, which is liquid at temperature of <100° C. at atmospheric pressure. Ionic liquids include two components, namely a cation component and an anion component. Furthermore, the term "reversible ionic liquid" denotes in this context that the molecular components comprising the ionic liquid can be transformed into ionic liquid and vice versa, either by application of heat, vacuum or by bubbling suitable gas, such as $N_2$ or suitable acid gas, such as $CO_2$, in the mixture of molecular components. It may also be possible to dissociate the ionic liquid by using acid-base chemistry. Preferably the reversible ionic liquid may be a combination of dissociated acid and base, which can be converted back to distillable acid and base forms by application of heat. Ionic liquids where the positive charge cannot be removed, such as 1,3-dialkylimidazoliums, tetraalkylphosphoniums, trialkylsulphoniums and tetraalkylammoniums are excluded from the ionic liquids which are used in the present invention.

The ionic liquids which are suitable for use in the present invention have a negligible vapour pressure at room temperature, typically about $10^{-10}$ Pa, but they can be converted into form, which has vapour pressure at 130° C.>0.01 Pa, preferably >0.1 Pa. The ionic liquids are soluble in water and insoluble in non-polar organic solvents. The ionic liquids are preferably biodegradable. In this context compounds and compositions are referred biodegradable if they reach a biodegradation level higher than 60%, evaluation being based on the so-called BOD5 (Biochemical oxygen demand after 5 days) or "Closed Bottle Test" (OECD 301D).

According to one embodiment of the invention the reversible ionic liquid is a protic ionic liquid, where the unconjugated base has an aqueous pKb value of <16, preferably <12, more preferably in the range between 0 and 12. The reversible ionic liquid may be a protic ionic liquid, where the unconjugated base has an aqueous pKb value in the range of 0-16, preferably 1-12, more preferably 5-12. The ionic liquid is dissociated by thermal and/or chemical methods, preferably by distillation, acid-base dissociation chemistry or by bubbling suitable gas, such as $N_2$ or suitable acid gas in the liquid, such as carbon dioxide.

According to one embodiment of the invention the reversible ionic liquid is prepared from a substituted primary, secondary or tertiary amine, such as tributylamine, from a substituted pyridine, from an alkylimidazole, from a substituted amidine or from a substituted guanidine, together with an inorganic or organic conjugate acid. The conjugate acid may be a carboxylic acid, such as propionic acid, hydrochloric acid, sulphuric acid, phosphoric acid, methyldihydrogenphosphonate, dimethylhydrogenphosphate or phosphinic acid. Preferably the conjugate acid is carboxylic acid. A preferable ionic liquid is prepared from a substituted guanidine, which is tetramethylguanidine (TMG), 1,1,2,3,3,-pentamethylguanidine (PMG) or 2-butyl-1,1,3,3-tetramethyl guanidine (BTMG). Tetramethylguanidine is preferred, especially for treating oil sands. Tetramethylguanidine propionate is being especially preferred. Another preferable ionic liquid is prepared by using a substituted amidine, which is 1,8-diazabicyclo-[5,4,0]-undec-7-ene (DBU).

According to one embodiment of the invention the reversible ionic liquid is prepared from 1,2-dimethyl-1,4,5,6-tetrahydropyrimidine (DTP) or imino-tris(dimethylamino) phosphorane (ITDP) with inorganic or organic conjugate acid. The conjugate acid may be a carboxylic acid, such as propionic acid, hydrochloric acid, sulphuric acid, phosphoric acid, methyldihydrogenphosphonate, dimethylhydrogenphosphate or phosphinic acid.

The reversible ionic liquid may also be N,N-dimethylammonium N',N'-dimethylcarbamate (DIMCARB) or any variant thereof.

In step (a) of the method a liquid phase comprising a reversible molten salt, preferably a reversible ionic liquid, is brought in a contact, e.g. by mixing in a reactor, with material comprising mineral solids and hydrocarbons, such as bitumen. Thus is obtained a mixture, which comprises at least 1) a solid phase comprising mainly or entirely of particles of the mineral solids, i.e. sand and/or clay particles, and 2) liquid phase, which comprises the molten salt and hydrocarbons. At least some hydrocarbons from the mineral solids are separated or dissociated from the mineral solids and extracted by a solid-liquid extraction to the liquid phase, because hydrocarbons are partially or completely soluble in the molten salt, such as ionic liquid. Advantageously there is only one liquid phase present in the step (a), i.e. it is a two-phase system comprising one solid phase and one liquid phase. In an embodiment some hydrocarbons separate into a separate hydrocarbon phase layer, which can be removed from the mixture. According to one embodiment the temperature during the separation and/or the extraction reaction is <100° C. Heat energy may be applied to the mixture, if needed.

According to one embodiment of the invention the ratio of molten salt, such as ionic liquid, to material which comprises mineral solids and hydrocarbons, may be in the range of 0.1-10 preferably 0.5-7 more preferably 1-5.

According to one embodiment of the invention the step (a) is essentially free of VOC (Volatile Organic Compound) generating organic solvents, such as toluene, kerosene, xylene, hexane, benzene or naphtha. In this manner the VOC emissions from the process can be kept low or non-existent. Preferably all process steps are free of VOC generating organic solvents. In this context hydrocarbon compounds having boiling point <80° C., low to medium water solubility, high vapour pressure and low molecular weight are considered as VOC generating organic solvents.

In step (b) of the method the mineral solids phase is separated from the liquid phase, which comprises molten salt and hydrocarbons. The separation of the different phases may be performed by using any conventional separation method, which is suitable for the purpose, e.g. settling, filtering, centrifuging or the like.

The mineral solids phase from step (b) may be processed further, e.g. by washing. Sometimes the separated mineral solids phase may contain some remaining molten salt, such as ionic liquid. According to one embodiment of the invention a liquid extraction agent is added to the separated mineral solids phase from step (b), the remaining molten salt, such as ionic liquid, is extracted from the mineral solids phase and the mineral solids phase is separated from the liquid phase. The liquid extraction agent may be water, methanol, ethanol or any of their mixtures. This means that the molten salt, possibly remaining in the mineral solids phase and separated together with it, can be effectively recovered with a simple wash or extraction with the extraction agent, such as water or ethanol. The liquid phase from this subprocess may be combined with the main process flow. All this improves the recyclability degree of the molten salt, such as ionic liquid, in the process. At the same time the resulting mineral solids phase obtained is relatively pure and can be piled or used as a landfill.

The liquid phase from step (b), which comprises the main part of the molten salt, such as ionic liquid, as well as hydrocarbons, is transported to step (c), where hydrocarbons are separated from the liquid phase. The separation of hydrocarbons from the liquid phase may be performed by precipitation or by distillation. For example, the separation of hydrocarbons from the liquid phase may be obtained by precipitation, where a liquid extraction agent is used. The liquid extraction agent may be water, methanol, ethanol or any of their mixtures, and it may same or different than the extraction agent used for possible separation of molten salt, such as ionic liquid, from the mineral solids phase after its separation in step (b). The extraction agent causes the precipitation of hydrocarbons from the liquid phase, which comprises the molten salt. Thus a two phase system is created, where the precipitated hydrocarbons form the solid phase and the molten salt, such as ionic liquid, and the extraction agent form the liquid phase. The hydrocarbon precipitate is separated from the liquid phase comprising molten salt. The separation may be done by using any suitable method known as such. Other alternative is to separate hydrocarbons from the liquid phase comprising the molten salt, such as the ionic liquid, by distillation, as they distil at different temperatures.

The separated hydrocarbon precipitate or separated distilled hydrocarbon fractions from the present process may be used for manufacture of synthetic crude oil. The separated hydrocarbons may be processed further e.g. for removal of excess carbon and for addition of hydrogen.

In step (d) of the present method the liquid phase comprising molten salt, such as ionic liquid is recycled back to step (a) of the method. The liquid phase may comprise in this stage not only the molten salt but also variable amount(s) of extraction agent(s) or other liquid components. According to one preferable embodiment the volume of the liquid phase comprising the molten salt, such as the ionic liquid, is reduced before the liquid phase is recycled to step (a) of the method. The volume reduction may be done, for example, by evaporation. This is especially preferred if the amount of extraction agent and/or other liquid components has increased over a predetermined level in the liquid phase. According to one embodiment the amount of extraction agent in the liquid phase, which is recycled back to step (a), is less than 5 weight-%, even less than 1 weight-%, sometimes even less than 0.5 weight-%.

According to one embodiment of the invention the molten salt, such as the ionic liquid, in the liquid phase is regenerated after the liquid phase is separated from hydrocarbons in step (c), and before recycling to step (a), by distillation, acid-base dissociation chemistry or by bubbling gas in the liquid phase. In this manner the molten salt, such as the ionic liquid, can be reversed or dissociated and effectively recovered. However, it is not necessary to regenerate the molten salt, such as the ionic liquid, every time liquid phase is recycled from step (d) back to extraction step (a).

According to one embodiment of the invention at least 80%, preferably at least 90%, more preferably at least 95%, sometimes even at least 97% or at least 99% of the molten salt, such as the ionic liquid, fed to step (a) is recycled back to step (a).

The material comprising mineral solids and hydrocarbons may be crushed, milled or otherwise comminuted to a suitable particle size before it is brought into contact with the molten salt, such as the ionic liquid.

The material comprising mineral solids and hydrocarbons may be oil sand, oil shale, oil contaminated sand or oil contaminated earth, tailing pond material or sand containing crude oil. In the context of the present application the term "hydrocarbon" is understood as compounds comprising mainly hydrogen and carbon. Especially the term "hydrocarbon" denotes here naturally occurring, unrefined crude oil, bitumen, shale oil and the like. Bitumen is here understood as a highly viscous mixture of hydrocarbons heavier than pentanes.

According to one embodiment the present invention is especially suitable for separating hydrocarbons from oil sand. Oil sand is a mixture, which comprises hydrocarbons, such as semi-solid crude bitumen, water and mineral solids, such as silica sands and clay minerals. Oil sand may comprise 80-90 weight-%, preferably 82-90 weight-%, of mineral solids, such as mineral particles, and 1-18 weight-%, preferably 1-10 weight-% of hydrocarbons. The invention is even suitable for separating hydrocarbons from oil sand having a hydrocarbon content <15 weight-%, preferably <10 weight-%, more preferably <8 weight-%.

According to another embodiment the present invention is especially suitable for separating hydrocarbons from oil shale. Oil shale is an organic-rich fine-grained sedimentary rock comprising bitumen and kerogen, which is a solid mixture of various organic chemical compounds, mainly hydrocarbons, small amounts of sulphur, oxygen and nitrogen as well as a variety of minerals. Hydrocarbons can be separated from oil shale by first comminuting the oil shale to a suitable particle size and then treating the obtained comminuted material according to the method described in this application.

One embodiment of the invention is described in more detail with reference to appended schematical and non-limiting drawing, where FIG. 1 shows a flow chart for one embodiment of the present invention.

FIG. 1 shows a flow chart for one embodiment of the present invention. Oil sand, denoted with "O" and reversible molten salt, which is here a reversible ionic liquid, denoted with "IL" are fed to the step (a), where they are brought into contact which each other. Hydrocarbons are extracted from the oil sand in a two phase solid-liquid extraction and transferred to the liquid phase comprising the reversible ionic liquid.

In step (b) the mineral solids phase comprising sand is separated from the liquid phase, which comprises the ionic liquid and hydrocarbons, and the liquid phase is led to step (c) and the mineral solids phase is transferred to step (f).

In step (c) of FIG. 1 hydrocarbons are separated from the liquid phase by using liquid extraction agent, such as water or alcohol. In this manner hydrocarbons are precipitated and form a solid phase in a two-phase system, where the liquid phase comprises the extraction agent and ionic liquid. Alternatively hydrocarbons can be separated by distillation.

It is also possible that some hydrocarbons separate from the mixture of oil sand and the ionic liquid, and form a separate hydrocarbon phase layer. This separate hydrocarbon phase layer may be separated before hydrocarbon extracted to the liquid phase are separated, e.g. by precipitation or distillation.

In step (f) a liquid extraction agent is added to the separated mineral solids phase from step (b). Thus the ionic liquid is extracted from the mineral solids phase comprising sand. The mineral solids phase, denoted with "S" is separated from the liquid phase and excited from the process. The separated solid phase is relatively pure and can be piled or used as a landfill. The liquid phase comprising the ionic liquid and the extraction agent, such as water and/or alcohol, can be transferred to step (g) of the process.

After step (c) the hydrocarbon precipitate is separated in step (e) from the liquid phase comprising ionic liquid and the extraction agent. The separated hydrocarbon precipitate, denoted with "B" is exited from the process, and it can be used for manufacture of synthetic crude oil. The liquid phase is transferred to step (g).

In step (g) the volume of the liquid phase is reduced. For example, at least a part of the extraction agent may be removed from the liquid phase, e.g. by evaporation. The extraction agent can be led back to step (c) for separation of hydrocarbons by precipitation. The part of the liquid phase that comprises the ionic liquid can be transferred back to step (a) of the process.

It is possible that the liquid phase comprising the reversible ionic liquid is subjected to a regeneration step (h) after step (g) and before transferral to step (a). The regeneration of the ionic liquid in step (h) may be performed by distillation of the liquid phase, by acid-base dissociation chemistry or by bubbling gas through the liquid phase.

EXPERIMENTAL

Some embodiments of the invention are described in the following non-limiting examples.

Example 1

Extraction of Bitumen from Oil Sand

Efficiency of different ionic liquids was tested with an oil sand samples (Alberta, Canada)

One reversible ionic liquid (sample 1) and seven non-reversible ionic liquids (samples 2-7) were tested for oil sand processing. Following ionic liquids were used in respective samples:

1. 1,1,3,3-tetramethylguanidine propionate ([TMGH][$CO_2$Et])
2. 1,3-dimethylimidazolium dimethylphosphate ([mmim][$Me_2PO_4$])
3. 1-ethyl-3-methylimidazolium trifluoromethanesulfonate [emim][$CF_3SO_3$]
4. IoLiLyte 221PG, Commercial ionic liquid (IoLiTec Ionic Liquids Technologies GmbH, Germany)
5. 1-ethyl-3-methylimidazolium acetate ([emim][OAc]), 6. Tributylethylphosphonium diethyl phosphate ($[P_{4442}][Et_2PO_4]$)
7. A mixture of 1-ethylimidazole and propionic acid
8. Choline propionate The test procedure was as follows:

10 g of molten ionic liquid was mixed with 5 g oil sand (Alberta, Canada) at room temperature. If no visible extraction had occurred after 5 min incubation period, the sample was heated with a heatgun (exact temperature after heating unknown). In Sample 1 the ionic liquid was first melted with the heatgun and heating was continued through mixing and incubation time. 10 g toluene was added into the mixture as a solvent, if deemed necessary. The extraction ability was evaluated through visual analyses and phase separation behavior.

The results are shown in Table 1.

TABLE 1

Results of Example 1.

| Sample No | Extraction Without Solvent | | toluene | Number of phases |
|---|---|---|---|---|
| | No heating | after heating | | |
| 1 | — | Yes | No | 2 |
| 2 | No | Yes | Yes | 3 |
| 3 | No | No | Yes | 3 |
| 4 | No | Partly | Yes | 3 |
| 5 | No | No | Yes | 3 |
| 6 | No | Partly | Yes | 3 |
| 7 | No | Partly | Yes | 3 |
| 8 | No | Partly | Yes | 3 |

The ionic liquid that was able to extract bitumen extensively, without organic solvent, was the reversible ionic liquid, $[TMGH][CO_2Et]$ (Sample 1). All non-reversible ionic liquids formed a suspension which slowly separated to 3 different phase layers, namely, a bottom phase comprising sand, a middle phase comprising the respective ionic liquid and a top phase comprising toluene/bitumen.

Example 2

Bitumen Recovery from Oil Sands 10 g of $[TMGH][CO_2Et]$ was heated upon melting point, ~60° C. after which it was mixed with 5 g oil sand (Alberta, Canada). Mixture was kept molten by using a heatgun. Extraction began immediately and sand was turning powdery. After 5 min incubation period the bitumen/ionic liquid fraction was isolated by filtrating sand off using cotton wool on a Pasteur pipet. The bitumen was further precipitated with an addition of $H_2O$. The bitumen was effectively recovered from the ionic liquid with water. The excess ionic liquid was easily recovered from sand tailings with water.

Even if the invention was described with reference to what at present seems to be the most practical and preferred embodiments, it is appreciated that the invention shall not be limited to the embodiments described above, but the invention is intended to cover also different modifications and equivalent technical solutions within the scope of the enclosed claims.

The invention claimed is:

1. A method for separating hydrocarbons, from a material comprising mineral solids comprising hydrocarbons, the method comprising at least the steps of (a) bringing a liquid phase comprising a reversible molten salt, in contact with the mineral solids and extracting hydrocarbons to the liquid phase from the mineral solids in a two-phase system consisting of one solid phase and one liquid phase;

(b) separating the mineral solids phase from the liquid phase, which comprises molten salt and hydrocarbons;

(c) separating hydrocarbons from the liquid phase comprising molten salt; and (d) recycling the liquid phase comprising molten salt to step (a), wherein the reversible molten salt is a reversible ionic liquid having a vapour pressure about $10^{-10}$ Pa at room temperature but can be converted into a form having vapour pressure >0.1 Pa at 130° C. and the hydrocarbon is selected from the group consisting of crude bitumen, heavy crude oil and combination thereof.

2. The method according to claim 1, wherein the reversible ionic liquid is a protic ionic liquid, where the unconjugated base has an aqueous pKb value of <16, and which is dissociated by thermal or chemical or both methods.

3. The method according to claim 1, wherein the reversible ionic liquid is prepared from a substituted primary, secondary or tertiary amine, from a substituted pyridine, from a substituted amidine or from a substituted guanidine with inorganic or organic conjugate acid.

4. The method according to claim 3, wherein the substituted guanidine is tetramethylguanidine (TMG), 1,1,2,3,3,-pentamethylguanidine (PMG) or 2-butyl-1,1,3,3-tetramethyl guanidine (BTMG).

5. The method according to claim 3, wherein the substituted amidine is 1,8-diazabicyclo-[5.4.0]-undec-7-ene (DBU).

6. The method according to claim 3, wherein the acid is a carboxylic acid, hydrochloric acid, sulphuric acid, phosphoric acid, methyldihydrogenphosphonate, dimethylhydrogenphosphate or phosphinic acid.

7. The method according to claim 1, wherein the reversible ionic liquid is prepared from 1,2-dimethyl-1,4,5,6-tetrahydropyrimidine (DTP) or imino-tris(dimethylamino) phosphorane (ITDP) with inorganic or organic conjugate acid.

8. The method according to claim 1, wherein the reversible ionic liquid is N,N-dimethylammonium N',N'-dimethylcarbamate (DIMCARB).

9. The method according to claim 1, wherein the material comprising mineral solids is oil sand, oil shale, oil contaminated sand or oil contaminated earth, tailing pond material or sand containing crude oil.

10. The method according to claim 9, wherein the material comprising mineral solids is oil sand having a hydrocarbon content <15 weight %.

11. The method according to claim 9, wherein the material comprising mineral solids is oil shale, which is an organic-rich sedimentary rock mineral comprising bitumen and kerogen.

12. The method according to claim 1, wherein the separation of hydrocarbons from the liquid phase is performed by precipitation or by distillation.

13. The method according to claim 1, wherein the volume of the liquid phase comprising molten salt is reduced before the liquid phase is recycled to step (a).

14. The method according to claim 1, wherein the molten salt in the liquid phase is regenerated after the liquid phase is separated from hydrocarbons in step (c), and before recycling to step (a), by distillation, acid-base dissociation chemistry or by bubbling gas in the liquid phase.

15. The method according to claim 1, wherein the method further comprises the steps of adding a liquid extraction agent to the separated mineral solids phase from step (b), extracting the molten salt from the mineral solids phase and separating the mineral solids phase.

16. The method according claim 15, wherein the liquid extraction agent is water, methanol, ethanol or any of their mixtures.

17. The method according claim 1, wherein the step (a) is essentially free of organic solvents.

* * * * *